United States Patent [19]

Lipscomb et al.

[11] Patent Number: 5,003,695

[45] Date of Patent: Apr. 2, 1991

[54] COMPOUND ACTION ANVIL SNIPS

[75] Inventors: Dennis E. Lipscomb; Gary L. Wilhelm; Barbara G. Perna; Waldemar G. Guenthner, all of Statesboro, Ga.

[73] Assignee: Cooper Industries, Inc., Houston, Tex.

[21] Appl. No.: 494,924

[22] Filed: Mar. 13, 1990

Related U.S. Application Data

[63] Continuation of Ser. No. 353,199, May 15, 1989, abandoned, which is a continuation of Ser. No. 182,268, Apr. 15, 1988, abandoned.

[51] Int. Cl.[5] ..... B26B 17/00

[52] U.S. Cl. ..... 30/193; 30/186; 30/259

[58] Field of Search ..... 30/191, 192, 193, 134, 30/186, 259

[56] References Cited

U.S. PATENT DOCUMENTS

| | | | |
|---|---|---|---|
| 2,295,385 | 9/1942 | Connors | 30/193 |
| 2,528,815 | 11/1947 | Boyer | 30/186 |
| 3,324,549 | 6/1967 | Sharp | 30/181 |
| 3,372,478 | 3/1968 | Wallace et al. | 30/193 |
| 3,638,307 | 2/1972 | Stewart | 30/193 |
| 4,079,513 | 3/1978 | Harrison | 30/193 |
| 4,463,497 | 8/1984 | O'Keefe | 30/259 |
| 4,502,222 | 3/1985 | Sargent | 30/259 |

FOREIGN PATENT DOCUMENTS

| | | | |
|---|---|---|---|
| 647196 | 7/1928 | France | 30/239 |

*Primary Examiner*—Frank T. Yost
*Assistant Examiner*—Hwei-Siu Payer
*Attorney, Agent, or Firm*—Ned L. Conley; David A. Rose; William E. Shull

[57] ABSTRACT

A pair of cutting snips includes a pair of handles which are mounted to a pair of blades. Located on one of the blades is a pivotably mounted self-aligning anvil. When the handles are squeezed, the blades come together in such a manner that the workpiece is caught between a blade and the anvil such that the workpiece is cut in a linear fashion.

31 Claims, 2 Drawing Sheets

COMPOUND ACTION ANVIL SNIPS

This is a continuation of co-pending application Ser. No. 07/353,199, filed on May 15, 1989, now abandoned, which is a continuation of application Ser. No. 182,268, filed Apr. 15, 1988, now abandoned.

BACKGROUND OF THE INVENTION

The present invention relates to snips; more particularly, the present invention relates to compound action snips.

Snips for cutting a variety of materials such as wood, branches or sheetmetal are well known. Similarily, snips having a compound action are well known where it is necessary to provide additional force at the point of cutting.

While snips are common in most tool boxes they often provide a rough cut which leaves a jagged edge on the surfaces where the workpiece has been cut. A full understanding of the reasons for such a rough cut or jagged edge remains unknown; however it is believed that the compression of the material being cut as the blades come together in what might best be termed a traveling or collapsing "V" causes the workpiece to be partially torn apart rather than cleanly sheared. Additionally, the line of cut is also difficult to see because the blade is in the way.

The rough cut or jagged edge on a workpiece can be minimized if a clean shear is provided; however, such clean shears normally require the use of a powered shearing machine using hardened and sharpened blades. Such powered shearing machines are not portable and cannot be easily used by workmen who may be fitting moulding or firring strips at a construction site. There is therefore a need in the art to provide snips whose results approximate those of a powered shearing machine; specifically smooth or non-jagged edges where the workpiece has been severed.

While some snips in the prior art have attempted to solve this problem by moving one blade into another in an approximately parallel or linear fashion; the geometry of single pivot snips necessitates that the cut be a traveling or collapsing "V". Such cuts typically are characterized by rough or jagged edges.

SUMMARY OF THE INVENTION

The compound action anvil snips of the present invention which cut a workpiece in a substantially linear fashion to avoid rough or jagged edges include a pair of handles, a compound blade actuating and mounting mechanism, a sharpened blade and an anvil support blade and a self-aligning pivotable anvil mounted on the anvil support blade.

The sharpened blade and the anvil support blade are connected to the handles by the compound actuating and mounting mechanism such that when the handles are squeezed together the compound actuating mechanism causes the sharpened blade and the self-aligning pivotable anvil to come together. On the anvil support blade the self-aligning pivotable anvil is attached at a pivot point. Preferably the pivotable mounting of the anvil is substantially in the center of the edge of the anvil support blade. As the blades come together to cut the workpiece, the action of the sharpened blade and the positioning of the workpiece by the self-aligning pivotable anvil causes the workpiece to be cut without rough or jagged edges.

BRIEF DESCRIPTION OF THE DRAWINGS

A better understanding of the compound action anvil snips of the present invention may be had by reference to the figures wherein.

DETAILED DESCRIPTION OF THE EMBODIMENTS

Figure 1:
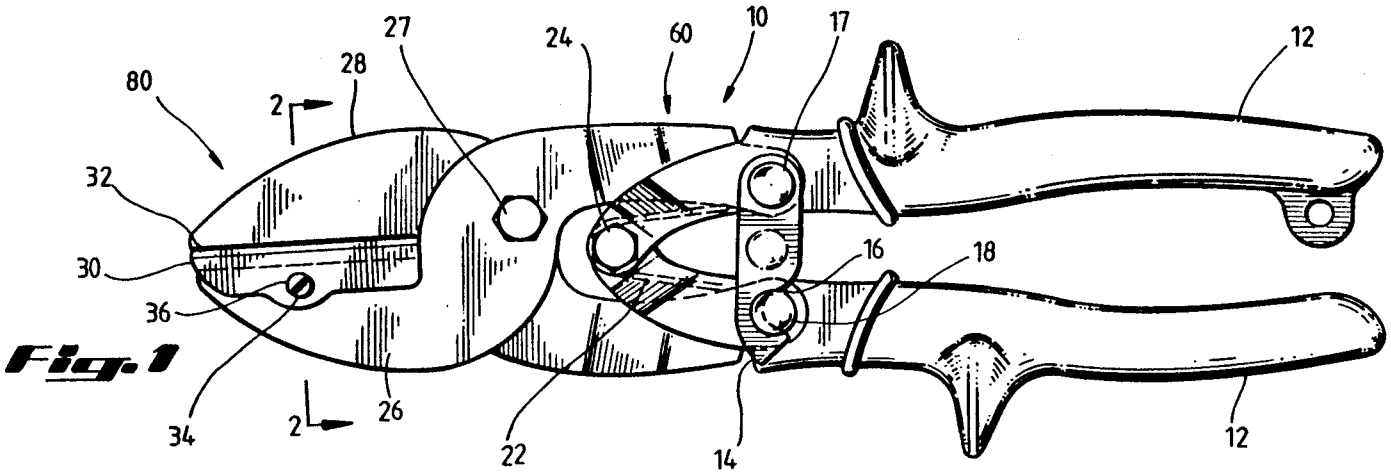
FIG. 1 is a top plan view of the compound action anvil cutting snips of the present invention.
Figure 2:
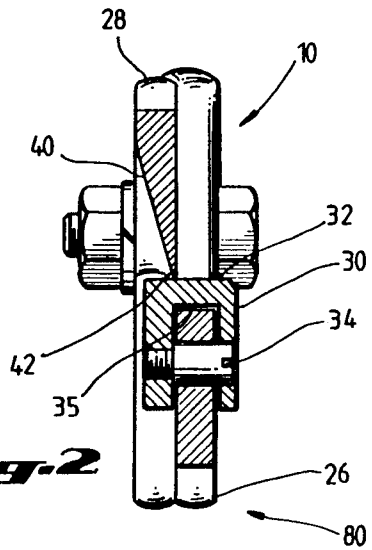
FIG. 2 is a front view in partial section taken at line 2—2 of FIG. 1.
Figure 6:
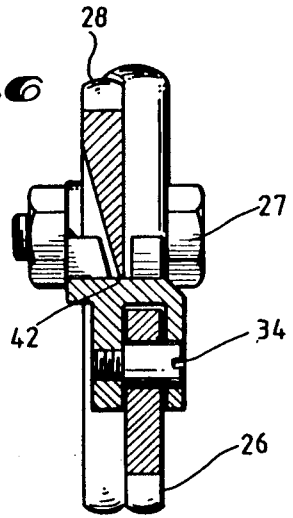
FIG. 6 is a front view in partial section taken at line 6—6 of FIG. 5.
Figure 3:
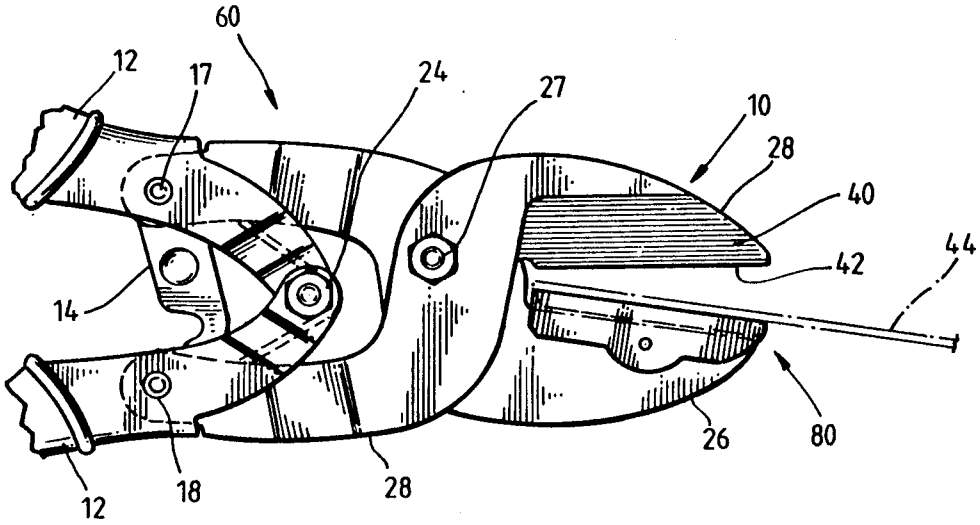
FIG. 3 is a bottom plan view of the snips in conjunction with a workpiece.

The compound action anvil snips of the present invention may be best understood by reference to FIGS. 1, 2 and 3. Therein it may be seen that snips 10 include three basic elements; handles 12, compound blade actuating and mounting mechanism 60 and blade pair 80.

Figure 4:
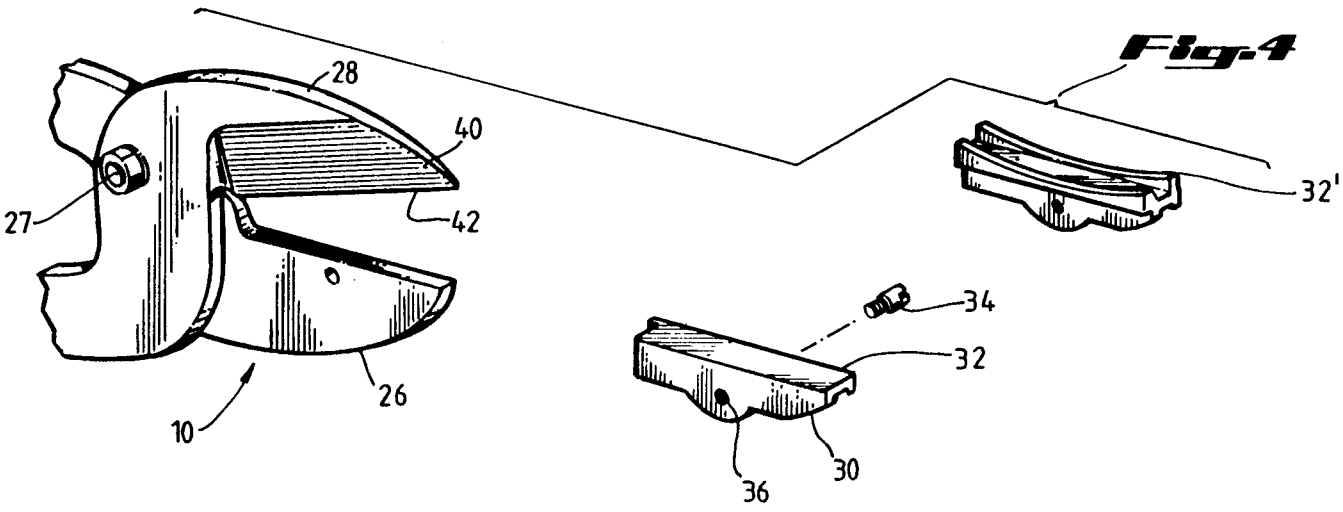
FIG. 4 is a exploded perspective view of the front end of the snips of the present invention showing both the preferred and alternate embodiments of the anvil.

Handles 12 are shaped and sized to fit the human hand. They are joined at first pivot 24 and are connected to compound blade actuating and mounting mechanism 60. Compound blade actuating and mounting mechanism 60 is in turn connected to blade pair 80. Blade pair 80 includes an anvil support blade 26 and a sharpened blade 28. Located on anvil support blade 26 is a pivotably mounted self-aligning anvil 30 which is connected to the anvil support blade 26 at pivot 34. An exploded view of the pivot mounting of anvil 30 to anvil support blade 26 is shown in FIG. 4.

If desired, blade actuating and mounting mechanism 60 may include a locking assembly which consists of a lock bar 14 and lock pin 18. This locking assembly may be used to keep snips 10 closed when not in use. Lock socket 16 in lock bar 14 is placed over lock pin 18 such that handles 12 may not be opened unless lock bar 14 is rotated away from lock pin 18 at second pivot 17. Lock pin 18 and second pivot 17 pass through handles 12 to provide a pivotal mounting for blade pair 80 as shown in FIG. 3.

A better understanding of the compound mounting of blades pair 80 to handles 12 may be had by reference to FIG. 3. Therein it may be seen that the base of blades 26 and 28 pivot with respect to handles 12. This mounting provides a lever action such that a lesser force and greater distance on the handles is translated into a greater force and lesser distance at the blades. Therefore as handles 12 move one with respect to another blade pair 80 opens and closes. Biasing snips 10 to the open position is spring 22 which is wrapped around first pivot 24 and urges each blade upward.

The motion of blade 26 with respect to blade 28, is controlled by second pivot 27. The location of second pivot 27 and the compound action of actuating and mounting arrangement 60 causes blades 26 and 28 to close in a substantially parallel manner. Despite such a complex blade mounting geometry such snips will still often cut in collapsing "V" particularly on thicker workpieces such as molding or firring strips.

As may be seen by specific reference to FIG. 2, sharpened blade 28 includes a honed surface 40 and an edge 42. Anvil support blade 26 has a blunt surface 35. Covering blunt surface 35 is an anvil 30 which is rotatably mounted substantially in the center of the blunt surface of anvil support blade 26. Anvil 30 is free to rotate about pivot screw 34 which is secured by threads 36. It is rotatable anvil 30 which together with the substantially parallel closing of blade pair 80 eliminates rough cuts or jagged edges on the workpiece. The honed surface 40 enables the user to see the cut as it progresses through workpiece 44 (FIG. 3).

Figure 5:
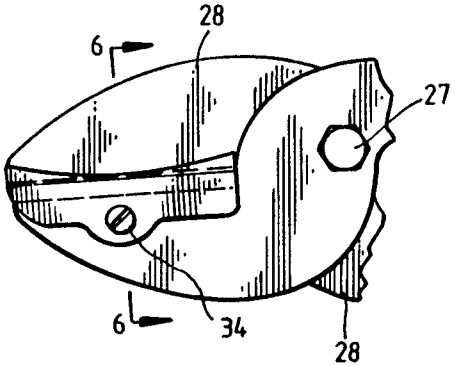
FIG. 5 is a top plan view of the snips showing the alternate embodiment of the anvil.

In the preferred embodiment the top of anvil 30 has flat surface 32. If desired and as is shown in FIGS. 4 and 5, an arcuate surface 32' may be used instead of flat surface 32. Such arcuate surface 32' has been shown to be particularly helpful if the snips of the present invention are used for cutting poultry bones or the like.

In the preferred embodiment, snips 10 of the present invention have been successfully used at worksites to cut moulding or firring strips without leaving rough or jagged edges. Such cuts have a marked advantage over the more ragged cuts provided by conventional snips in that the cut edges need not be finished by trimming off small splinters or flashing.

It has been found that the compound action anvil snips of the present invention may be made of any metallic material of sufficient hardness to maintain its shape while cutting a workpiece. If desired, the handles may be covered with a soft material to cushion the grip and provide more comfort for user's hands.

The foregoing embodiments are intended to illustrate the present invention and not to limit it in spirit or scope.

I claim:

1. Cutting snips comprising:

a pair of handles;

a pair of cutting blades pivotally connected to each other and to said handles such that a squeeze force on said handles is converted into a closing force for said pair of blades;

an anvil member disposed on the edge of one of the blades in a position to be engaged by the other blade when the blades are closed;

means pivotally attaching said anvil member to said one of said blades so that in use, when engaged by the other blade, the anvil member is pivoted to a position parallel to the other blade;

whereby the cutting snips cut a workpiece such that a smooth or non-jagged edge is provided on the workpiece.

2. The cutting snips as defined in claim 1 wherein said means for pivotally attaching said anvil member to one of said blades includes a pivot screw.

3. The cutting snips as defined in claim 1 wherein said anvil member is substantially flat, and said anvil member is attached to said one blade.

4. The cutting snips as defined in claim 3 wherein said means for pivotally attaching said anvil member to said anvil support blade is located substantially in the center of the edge of said anvil support blade.

5. The cutting snips as defined in claim 3 wherein said means for pivotally attaching said anvil member to one of said blades includes a pivot screw.

6. The cutting snips as defined in claim 1 wherein said anvil member has an arcuate surface, and said anvil member is attached to said one blade.

7. The cutting snips as defined in claim 6 wherein said means for pivotally attaching said anvil member to one of said blades includes a pivot screw.

8. The cutting snips as defined in claim 6 wherein said means for pivotally attaching said anvil member to said anvil support blade is located substantially in the center of the edge of said anvil support blade.

9. The cutting snips as defined in claim 1 wherein said pair of blades includes an anvil support blade and a sharpened blade, and said anvil member is attached to said anvil support blade.

10. The cutting snips as defined in claim 9 wherein said means for pivotally attaching said anvil member to one of said blades includes a pivot screw.

11. The cutting snips as defined in claim 9 wherein said means for pivotally attaching said anvil member to said anvil support blade is located substantially in the center of the edge of said anvil support blade.

12. The cutting snips as defined in claim 11 wherein said means for pivotally attaching said anvil member to said anvil support blade includes a pivot screw.

13. The cutting snips as defined in claim 12 wherein said anvil member includes a substantially arcuate surface.

14. The cutting snips as defined in claim 9 wherein said anvil member has a substantially arcuate surface.

15. The cutting snips as defined in claim 14 wherein said means for pivotally attaching said anvil member to said anvil support blade is located substantially in the center of the edge of said anvil support blade.

16. The cutting snips as defined in claim 9 wherein said anvil member is substantially flat.

17. The cutting snips as defined in claim 16 wherein said means for pivotally attaching said anvil member to one of said blades includes a pivot screw.

18. The cutting snips as defined in claim 16 wherein said means for pivotally attaching said anvil member to said anvil support blade is located substantially in the center of the edge of said anvil support blade.

19. The cutting snips as defined in claim 9 wherein said sharpened blade has a single honed edge.

20. The cutting snips as defined in claim 19 wherein said means for pivotally attaching said anvil member to one of said blades includes a pivot screw.

21. The cutting snips as defined in claim 19 wherein the means for pivotally attaching said anvil member to said anvil support blade is located substantially in the center of the edge of said anvil support blade.

22. The cutting snips as defined in claim 21 wherein said means for pivotally attaching said anvil member to said anvil support blade further includes a pivot screw.

23. The cutting snips as defined in claim 19 wherein said anvil member includes a substantially arcuate surface.

24. The cutting snips as defined in claim 23 wherein said means for pivotally attaching said anvil member to one of said blades includes a pivot screw.

25. The cutting snips as defined in claim 23 wherein said means for pivotally attaching said anvil member to said anvil support blade is located substantially in the center of the edge of said anvil support blade.

26. The cutting snips as defined in claim 19 wherein said anvil member is substantially flat.

27. The cutting snips as defined in claim 26 wherein said means for pivotally attaching said anvil member to one of said blades includes a pivot screw.

28. The cutting snips as defined in claim 26 wherein said means for pivotally attaching said anvil member to said anvil support blade is located substantially in the center of the edge of said anvil support blade.

29. Cutting snips comprising:

a pair of handles;

an anvil blade and a sharpened blade pivotally connected to said handles, said blades pivotally attached so as to come together in a substantially parallel manner, said sharpened blade including a single ground edge;

said handle being pivotally connected together at a first pivot point, said first pivot point adapted for moving towards the distal end of said blades as said handles are pivoted towards each other, whereby a squeeze force on said handles is converted into closing force on said blades;

an anvil member having a substantially flat surface for engagement with said sharpened blade, said anvil member pivotally attached to said anvil blade at the center of said anvil member and disposed on the edge of the anvil blade which engages the sharpened blade;

whereby the snips may cut a workpiece without leaving a rough or jagged edge.

30. Cutting snips comprising a pair of handles pivotally connected to each other, an anvil blade and a sharpened blade on said handles so that a squeeze force on said handles is converted to a closing force for said blades, and an anvil member disposed on the edge of the anvil blade between the anvil blade and the sharpened blade, said anvil member having an anvil surface substantially perpendicular to the path of movement of the blades when a closing force is exerted on the blades, said anvil member being pivotally mounted on said anvil blade for pivoting in a plane substantially parallel to the path of movement of the blades a sufficient distance to allow the anvil surface to pivot to a position parallel to the cutting edge of the sharpened blade both upon initial engagement of the sharpened blade and the anvil surface with a workpiece and upon cutting all the way through the workpiece, whereby upon placement of a workpiece between the sharpened blade and the anvil surface and squeezing the handles with a workpiece-penetrating force, the sharpened blade cuts through the workpiece without the formation of a traveling "V", thereby avoiding tearing of the workpiece.

31. Cutting snips comprising a pair of handles, an anvil blade and a sharpened blade, each pivotally connected to one of said handles at a first pivot point and pivotally connected to each other at a second pivot point, said handles being pivotally connected together at a third pivot point, intermediate said first and second pivot points, whereby when said handles are squeezed together a squeeze force on said handles exerts a closing force on said blades and said blades move toward each other in a substantially parallel manner, and an anvil member disposed on the edge of the anvil blade between the anvil blade and the sharpened blade, said anvil member having an anvil surface substantially perpendicular to the path of movement of the blades when they move toward each other, said anvil member being pivotally mounted on said anvil blade for pivoting in a plane substantially parallel to the path of movement of the blades a sufficient distance to allow the anvil surface to pivot a position parallel to the cutting edge of the sharpened blade both upon initial engagement of the sharpened blade and the anvil surface with a workpiece and upon cutting all the way through the workpiece, whereby upon placement of a workpiece between the sharpened blade and the anvil surface and squeezing the handles with a workpiece-penetrating force, the sharpened blade cuts through the workpiece without the formation of a traveling "V", thereby avoiding tearing of the workpiece.

* * * * *

UNITED STATES PATENT AND TRADEMARK OFFICE

CERTIFICATE OF CORRECTION

PATENT NO. : 5,003,695

DATED : April 2, 1991

INVENTOR(S) : D.E. Lipscomb, G.L. Wilhelm, B.G. Perna, W.G. Guenthner

It is certified that error appears in the above—identified patent and that said Letters Patent is hereby corrected as shown below:

Col. 5, line 7, delete "handle" and insert --handles--.

Col. 6, line 29, after "pivot" insert --to--.

Signed and Sealed this

Thirteenth Day of July, 1993

Michael K. Kirk

MICHAEL K. KIRK

*Acting Commissioner of Patents and Trademarks*

*Attest:*

*Attesting Officer*